US010040188B2

(12) United States Patent
Huang

(10) Patent No.: US 10,040,188 B2
(45) Date of Patent: Aug. 7, 2018

(54) RATCHET HANDLE HAVING AN EXTENSION MEMBER

(71) Applicant: Test Rite Products Corp., Ontario, CA (US)

(72) Inventor: Kevin Kai Huang, Diamond Bar, CA (US)

(73) Assignee: TEST RITE PRODUCT CORP., Ontario, CA (US)

( * ) Notice: Subject to any disclaimer, the term of this patent is extended or adjusted under 35 U.S.C. 154(b) by 376 days.

(21) Appl. No.: 14/750,937

(22) Filed: Jun. 25, 2015

(65) Prior Publication Data

US 2016/0375573 A1 Dec. 29, 2016

(51) Int. Cl.

*B25G 1/04* (2006.01)
*B25B 13/46* (2006.01)
*B25G 1/00* (2006.01)

(52) U.S. Cl.

CPC ..... *B25G 1/043* (2013.01); *B25B 13/463* (2013.01); *B25G 1/005* (2013.01)

(58) Field of Classification Search

CPC . B25G 1/04; B25G 1/043; B25G 1/08; B25G 1/085; B25B 13/463
USPC ..... 81/177.2
See application file for complete search history.

(56) References Cited

U.S. PATENT DOCUMENTS

| | | | | |
|---|---|---|---|---|
| 341,986 | A * | 5/1886 | Alapaw | B25B 13/463 81/177.4 |
| 505,535 | A * | 9/1893 | Porstendorfer | B25B 13/463 192/44 |
| 3,875,829 | A * | 4/1975 | Evans | B25B 13/06 81/177.2 |
| 5,148,724 | A * | 9/1992 | Rexford | B25B 13/06 81/124.4 |
| 5,522,287 | A * | 6/1996 | Chiang | B25B 13/461 81/125.1 |
| 6,053,077 | A * | 4/2000 | Huang | B25B 13/463 81/59.1 |
| 7,421,931 | B2 * | 9/2008 | Hu | B25B 13/461 81/177.4 |
| 2012/0060656 | A1 * | 3/2012 | Chang | B25B 23/0035 81/438 |

* cited by examiner

*Primary Examiner* — Hadi Shakeri
(74) *Attorney, Agent, or Firm* — Treasure IP Group, LLC

(57) ABSTRACT

The present invention discloses one-piece combinational tool that a worker can use to remove a nut or bolt. The combinational tool is a ratchet handle having an elongated ratchet shaft and a built-in extension bar. The ratchet shaft comprises a head portion, a tail portion and a transitional middle portion connecting the two. The head portion comprises a square drive log and a hexagonal attachment, disposed on opposing surfaces of the ratchet shaft. The tail portion comprise a hollow chamber which can accommodate the extension bar when it is not used.

9 Claims, 4 Drawing Sheets

10
40
50
60
200
30
220
20
210
110
120
190
130
thread
80
90
chamber
70
thread
100

RATCHET HANDLE HAVING AN EXTENSION MEMBER

FIELD OF THE INVENTION

The present invention relates to a ratchet handle, specifically to a ratchet handle having a built-in extension member and a torque multiplier member.

BACKGROUND OF THE INVENTION

A ratchet handle is mostly used with a set of extension bars in order to access hard to reach areas. Further sometimes, when a worker is working with a hard to remove part or a part with rusted surfaces, a torque multiplier is needed. Currently in hand tools offered in the marketplace, an extension bar and an attached torque multiplier are offered as separate tools for a worker, which means a worker has to carry a set of tools to a job location. And because the extension bars and other attachment accessories are smaller items, which can be easily misplaced or get lost from the tool set, if they are separable from the primary tool.

Therefore there is a need to provide a single versatile hand tool, which can be easily adapted for multiple purposes. When the hand tool is not in use, the small attachment parts can be secured to the tool in one piece to prevent misplacement.

SUMMARY OF THE INVENTION

The present invention discloses a one-piece combinational tool that a worker can use to remove a nut or bolt. The ratchet handle comprises a ratchet shaft and a built-in extension bar. The ratchet shaft has a first surface having a square drive member, configured to allow an extension member to be attached. Additionally, the ratchet shaft has a second surface having a hexagonal attachment means, configured to allow a second hand tool or another accessory to be attached to apply additional torque.

It s one object of the present invention to combine all the advantages of the reversible lever ratchet into one integral product with enhanced abilities to remove parts and access hard to reach areas.

It is another object of the present invention to provide a hand tool having a shaft, having a smooth surface but no sharp edges to prevent finger cut. Further the shaft needs to be ergonomically designed to be user friendly and allow a comfortable grip for either left handed workers or right handed workers, or both.

It is another object of the present invention to provide a hand tool with high precision, small operating angles so that it can be easily used even in difficult to rotate narrow places.

The one-piece combinational hand tool disclosed herein is a ratchet handle having enhanced abilities. The improved ratchet handle comprises an elongated ratchet shaft and a built-in extension bar. The elongated ratchet shaft comprises an enlarged head portion, and a tail portion and a transitional middle portion. The head portion has a first surface, which is a bottom surface when it is being used, and a second surface, which is a top surface when it is being used, wherein the bottom surface has a first attachment means, configured to releasably receive a first connecting end of the extension bar to form a first secure connection; and the bottom surface has a second attachment means, configured to receive a second hand tool, and the first attachment means can move in accordance with the second attachment means. The tail portion of the elongated ratchet shaft, which is hollow, can allow the built-in extension bar to be placed inside when it is not being used. The transitional middle portion is provided between the head portion and the tail portion of the elongated ratchet shaft.

BRIEF DESCRIPTION OF THE DRAWINGS

Embodiments of the present invention will now be described, by way of example only, with reference to the following drawings in which:

FIG. 5*a* is an illustration for the second attachment means when it is used with a wrench;

FIG. 5*b* is an illustration of a second ratchet that the second attachment means configured to be used with.

DETAILED DESCRIPTION OF THE PREFERRED EMBODIMENTS

For purposes of summarizing the invention and the advantages achieved over the prior art, certain advantages of the invention have been described herein. It is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

Figures 1, 2A, 2B, 2C, 2D:
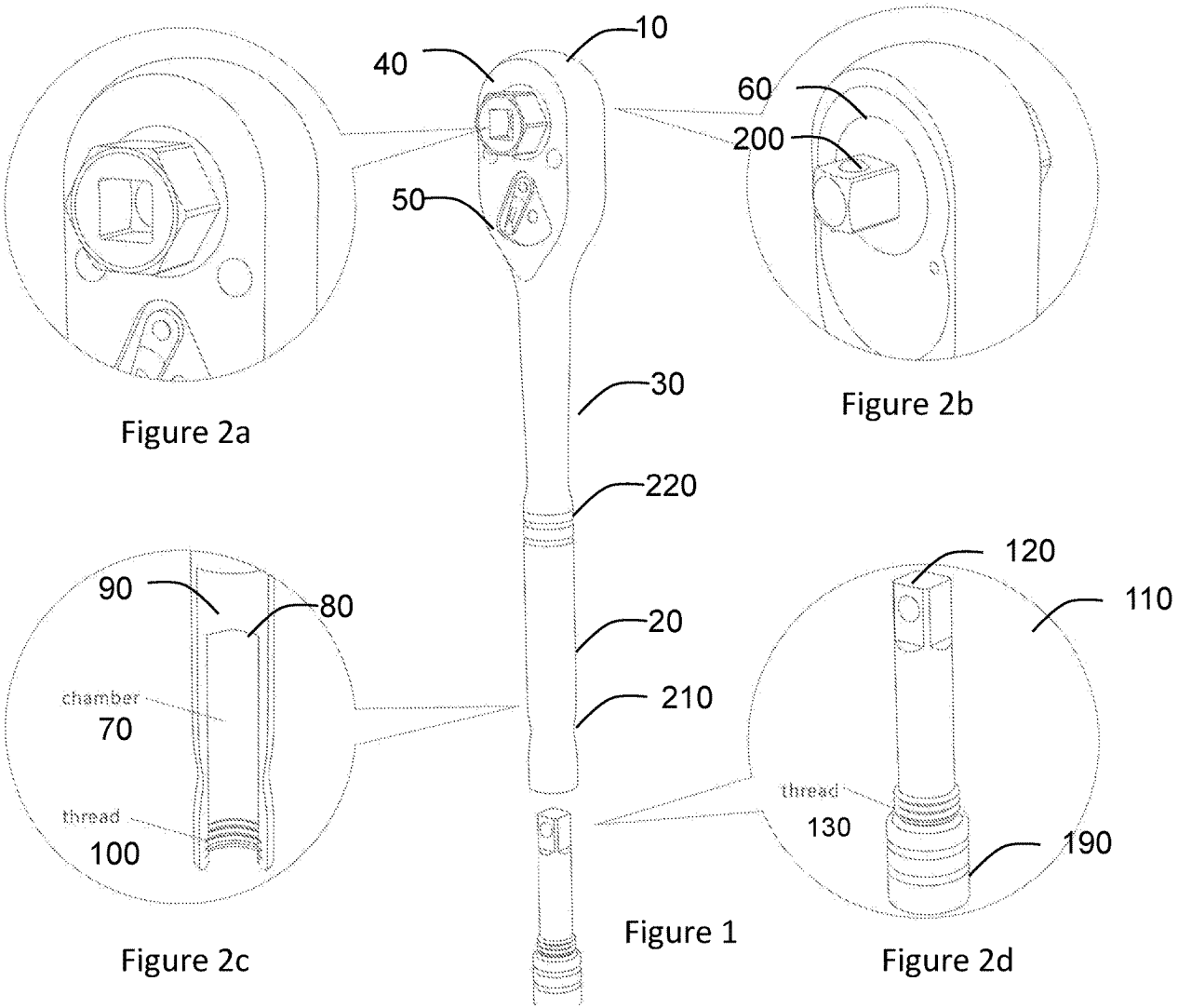
FIG. 1 is a perspective view of an exemplary embodiment of the present invention.
FIG. 2*a* is a zoomed perspective view of a second surface of the ratchet shaft in FIG. 1.
FIG. 2*b* is a zoomed perspective view of a first surface of the ratchet shaft in FIG. 1.
FIG. 2*c* is a cross section view of a tail portion of the ratchet shaft in FIG. 1.
FIG. 2*d* is an enlarged perspective view of a built-in extension bar of the ratchet handle in FIG. 1.
Figure 3:
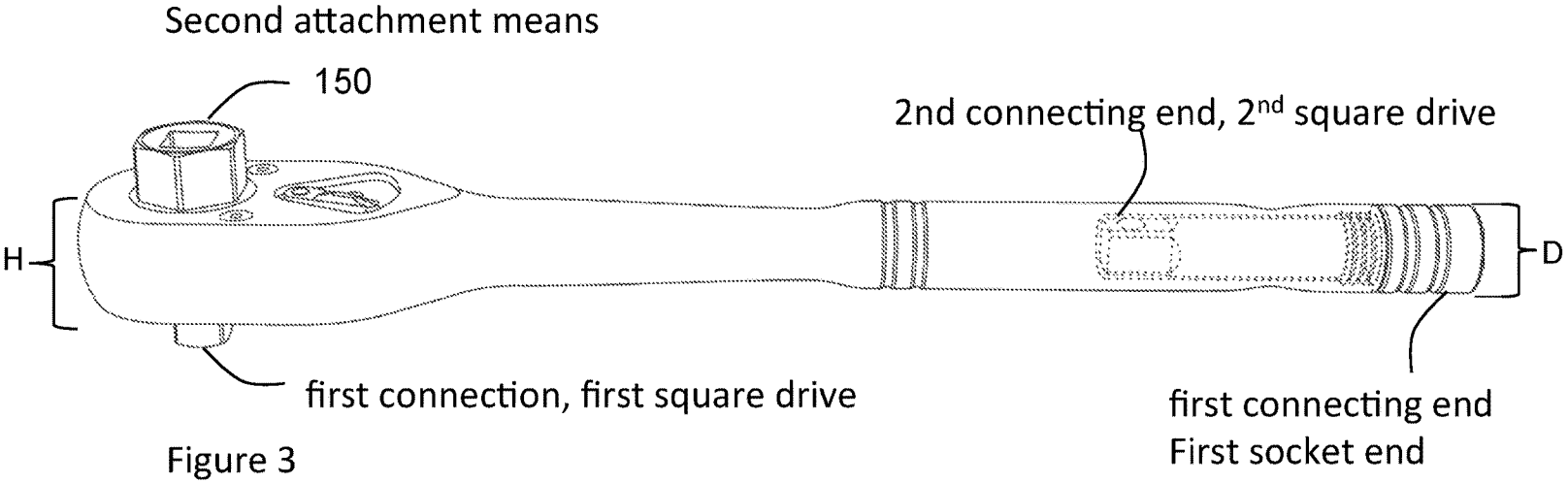
FIG. 3 is a side perspective view of the ratchet handle of FIG. 1, wherein the first surface faces the bottom.
Figure 4:
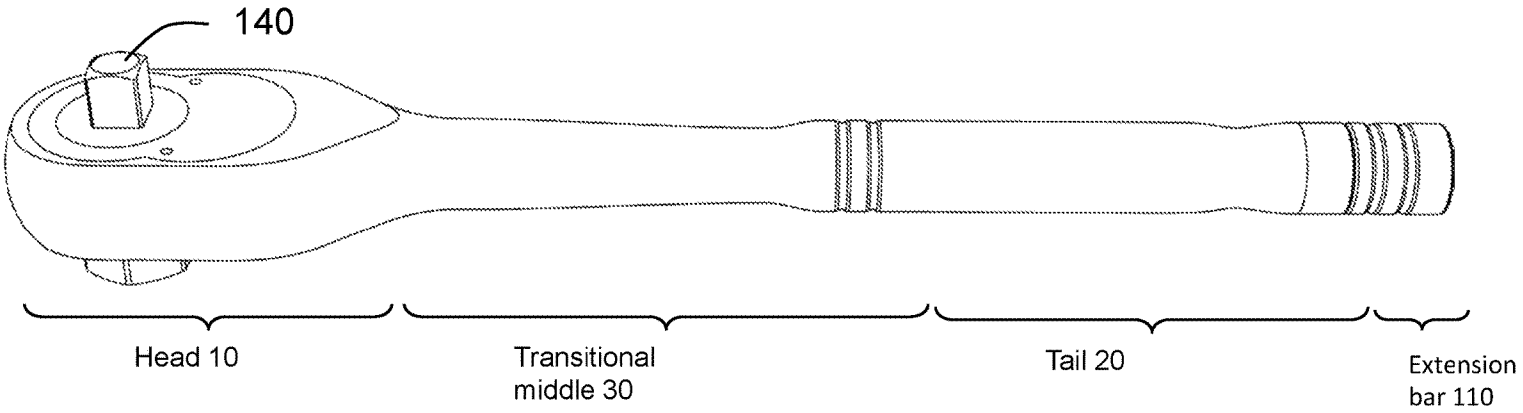
FIG. 4 is a side perspective view of the ratchet handle of FIG. 1, wherein the second surface faces the bottom.

In the scope of the present invention, referring to FIGS. 1 and 4, a ratchet handle has an elongated shaft and a built-in extension bar (110). One end of the shaft is an enlarged head portion (10), and the other end of the shaft is a hollow tail portion (20). The portion between the head portion (10) and tail portion (20) is a transitional middle portion (30). The head portion (10), tail portion (20) and transitional middle portion (30) are one integral piece. The head portion (10) is configured to attach to a socket or the extension bar (110) from the bottom, or another hand tool from the top, when the ratchet handle is being used to tighten or loosen a nut or bolt. The tail portion (20) of the ratchet handle is configured to store the extension bar when it is not being used. The head portion (10) is an enlarged head. It can be round, oval or water droplet shaped. The tail portion (20) is in a substantially tubular form. The transitional middle portion (30) is somewhat an irregular rod shaped, having various diameters along its length direction. The transitional middle portion (30) connects and bridges the head portion (10) and tail portion (20), and further provides other beneficial ergonomic and aesthetic features. For example, on the exterior of the transitional middle portion (30), a set of surface grooves are provided to allow the handle to be held more easily. Referring to FIGS. 1, 3 and 4, when the built-in extension bar (110) is stored in the ratchet shaft, the first connecting end of the extension bar is exposed outside of the tail portion (20) of the ratchet shaft.

In accordance with one aspect of the present invention, the head portion of the ratchet shaft comprises a first surface (60) and a second surface (40). The first surface (60) and second surface (40) are arranged opposite to each other. When the ratchet handle is being used by a worker, in one example, the first surface (40) faces downwardly towards a nut and bolt assembly, whereas the second surface (60) faces up. In another example, the first surface (40) faces closer to a part configured to be removed, whereas the second surface (40) is disposed away from the same part but closer to the worker.

Further, referring to FIGS. 1 and 2*b*, according to a first aspect of the present invention, a first attachment means is disposed on the first surface of the head portion. The first attachment means is configured to attach to another accessory or one of the two connecting ends of the extension bar 110. In one embodiment, the first attachment means is connected to a socket or an extension bar or the like, as an insertion means. In another embodiment, the first attachment means is connected to another part as a receiving means. In one example, referring to FIG. 2*b*, the first attachment means is a small drive, wherein the cross section of the small drive is square shaped. Because the first attachment means drives the socket that is attached onto, it is also referred to as a square drive. The square drive member as shown, is raised above from the first surface. On one side of the square drive member, a ball shaped stop (200) is provided. The ball shaped stop (200) may be spring loaded, that can fit onto a recess in the socket receptacle or a similar place in a first connecting end of the extension bar. The ball stop on the square drive member latches and locks on the socket or the extension bar and remains firmly in place during use. When the square drive member latches on a socket, it moves the socket with it. When the square drive member latches on an extension bar, it effectively extends the ratchet handle to be used in hard to reach areas. After the use, the socket or the extension bar can be easily released by a pulling action. By pulling the interior wall of extension bar presses on the ball stop and break the connection.

In accordance with the aspects of the present invention, the square drive member can be of any standard sizes, including but is not limited to, ¼-inch, ⅜-inch, and ½-inch.

The first attachment means is configured to be placed in one end of the socket to form a secure connection during use. Because the prevailing industry standard sockets all have square openings, the drive of the first attachment means of the present invention has a square cross section. If, however, a socket having a triangle, round or other shaped opening, which needs to be fit into, then the cross section of the drive member of the first attachment means will be the corresponding shape of the opening of the socket. Further the dimension of the drive member of the first attachment means will also be designed to make the drive member bearing a ball stop to securely engage in the socket opening.

Further, the first attachment means is configured to be attached together with a first connecting end of the extension bar 110. The size and shape of the drive member of the first attachment means match the size and shape of the first connecting end of the extension bar 110, for the purpose of forming a secure connection during use. In one example, the first connecting end of the extension bar 110 has a square opening to receive the drive member of the first attachment means. In another example, the first connecting end of the extension bar 110 has a round opening to receive the drive member of the first attachment means wherein the cross section of the drive member of the first attachment means is round.

Figures 5A, 5B:
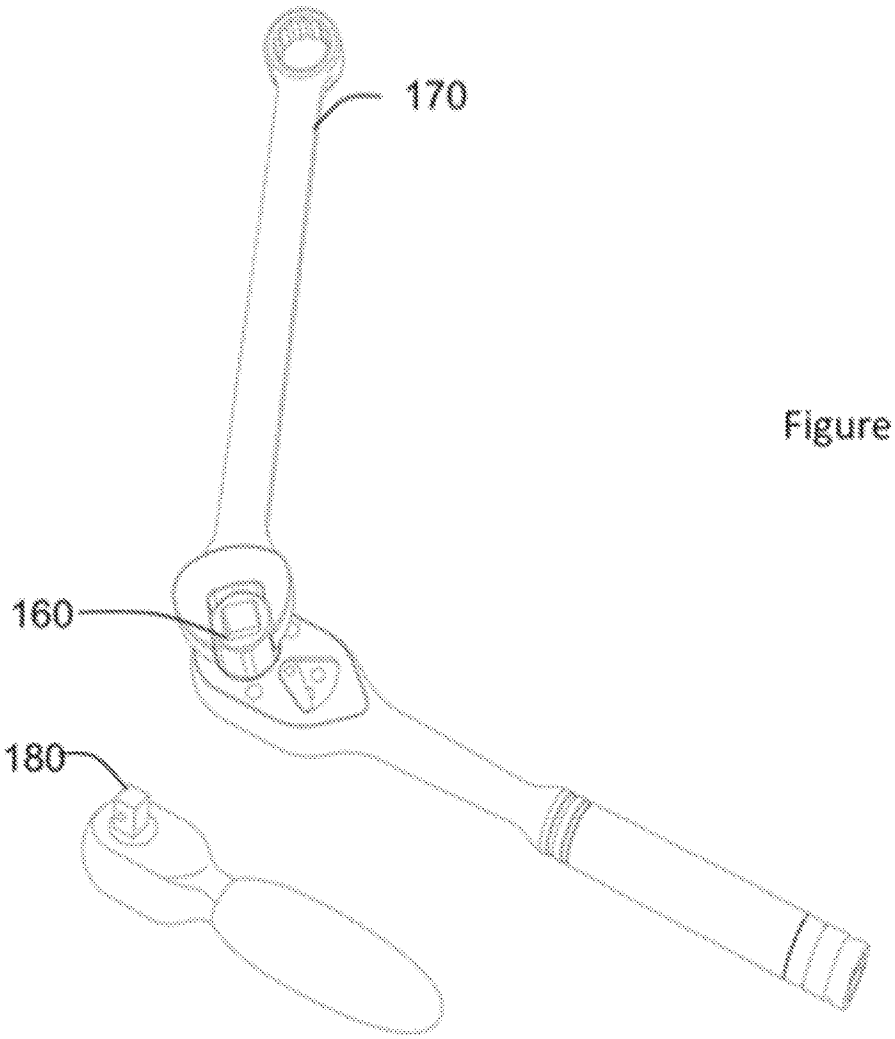

According to a second aspect of the present invention, a second attachment means 150 is disposed on the second surface of the head portion of the ratchet shaft. The second attachment means is configured to permit a second tool or a second tool accessory to anchor onto the second attachment means, to provide additional torque (FIGS. 5*a* and 5*b*). When the second attachment means 150 is rotated because of the second tool, the first attachment means 140 on the first surface of the head portion also rotates correspondingly. Exemplar second tools, as shown in FIGS. 5*a* and 5*b*, include but are not limited to another ratchet 180 or a wrench 170. When both the ratchet handle and wrench 170 are used together, the torque that can be applied to and through the second and first attachment means is significantly increased. An exemplary second tool accessory includes but is not limited to extension bars. In one example, the second attachment means is configured to attach to the built-in extension bar 110, through a second connecting end.

In one embodiment of the present invention, the second attachment means 150 is a receiving member. In another embodiment of the present invention, the second attachment means is an insertion member.

In one example of the present invention, the second attachment means 150 disposed on the second surface 40 of the ratchet shaft, substantially resembles a nut in shape, except the opening thereof is not threaded. The shape of the second attachment means 150 is preferred to be hexagonal, because a six-sided shape gives a good granularity of angles for a tool to approach and form a good grip, and have less small corners, which would be vulnerable to being rounded off. Also the hexagonal shaped second attachment means takes only ⅙th of a rotation to obtain the next side of the hexagon, which is an optimal shape to be used for high torque. In another examples, the shape of the second attachment means are polygons with more than 6 sides which may not give requisite grip, or polygons with less than 6 sides and may take more time to be given a complete rotation. In one instance, the exterior of the second attachment is configured to meet and be locked in position by a wrench as shown in FIGS. 5*a* and 5*b*.

In another example of the present invention, the second attachment means situated on the second surface of the ratchet shaft has an opening, capable to receive a second hand tool or tool accessory to allow application of additional torque. The opening of the second attachment means is designed to mate with the second hand tool or tool accessory to form a secure latch or connection during high torque application. The dimension and shape of the opening is configured to meet with the attachment end of the second tool and/or tool accessory. In one example, the opening of the second attachment means 150 is a square, configured to receive a second ratchet (180), as schematically indicated by FIGS. 5*a* and 5*b*. In another example, the opening of the second attachment means (150) is a square, configured to receive a second connecting end 120 of the built-in extension bar (110).

Figure 6B:
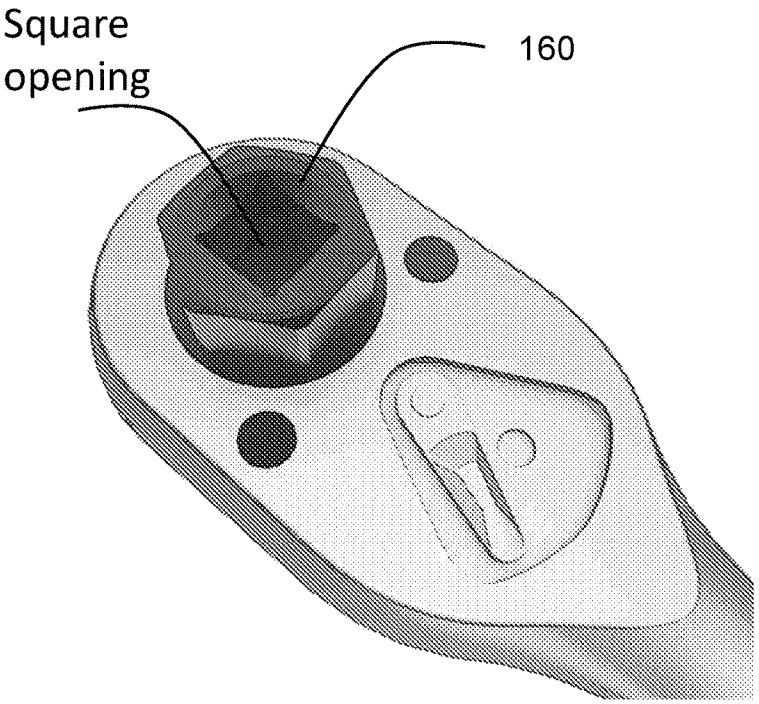
FIG. 6*a-b* are top perspective views of an exemplary hexagon head in accordance with the present invention.
Figure 6A:
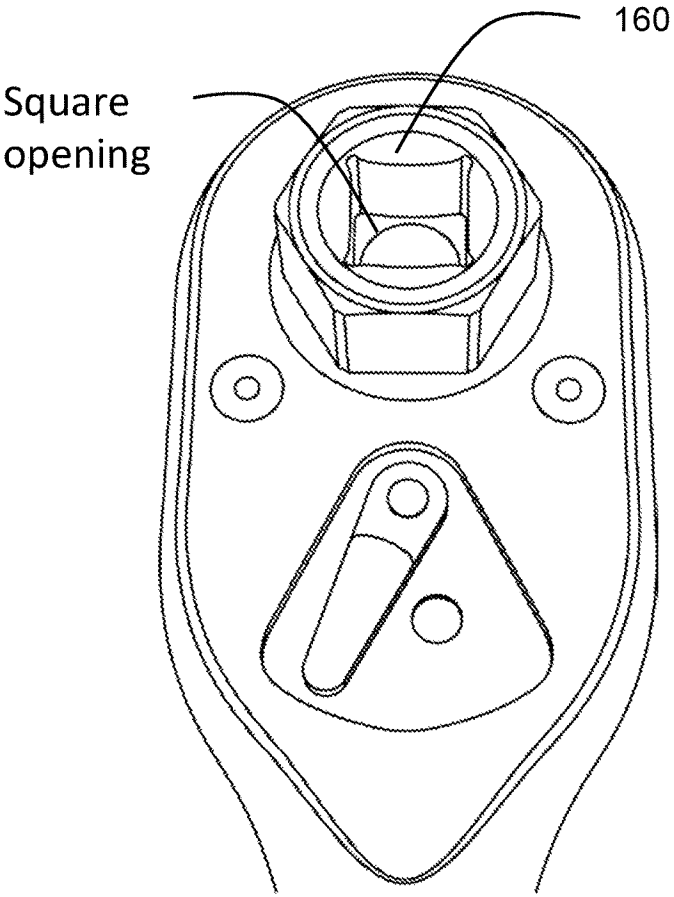

In yet another example of the present invention, referring to FIG. 6, the second attachment means on the second surface of the ratchet shaft has an a square opening 230. Declining surfaces 160 between the square opening 230 of an exterior of hexagonal attachment 150 are provided to prevent the sharp edges of the square opening 230 from rising above a flat surface of the hexagonal head 150 and causing cut in a worker's finger. As shown in FIG. 6, the surface is declined from an inner circle of the hexagon head to the edges of the opening. The area between periphery of the hexagon and inner circle forms a flat surface. Between the inner circle and edges of the square opening, a declined surface is formed.

Reversible Lever

In accordance with the aspects of the present invention, the head portion 10 of ratchet shaft further comprises a reversible lever 50, placed on the second surface thereof. The reversible lever 50 as shown in FIG. 1, is easy to select direction and easily lock, allowing a comfortable turn for either left handed workers or right handed workers, or both.

The reversible lever 50 operates a pawl inside the head portion 10 of the ratchet shaft. Pulling the shaft in one direction causes the pawl to engage in the ratchet teeth and turn the square drive 140. Moving the shaft in the opposite direction causes the pawl to slide over teeth, permitting the shaft to back up without moving the square drive 140. This allows rapid turning of either a nut or bolt attached through a socket or extension bar after each partial turn of the shaft. With the reversible lever in one position, the shaft can be used for tightening. In the other position, the shaft can be used for loosening. In one example of the present invention, the reversible lever 50 determines the turning direction of the square drive 140 and/or hexagonal attachment 150.

Tail Portion

According to a third aspect of the present invention, the tail portion of the ratchet shaft is provided. The tail portion (20) of the ratchet shaft is substantially a tubular form. In one embodiment, the tubular tail portion has a uniform diameter along its length direction. In another embodiment, the tubular tail portion has a non-uniform diameter along its length direction. In a preferred example, the tubular tail portion has a surface feature (210) towards a distal end of the tail portion, wherein the first surface feature is an indication of the finger holding position to facilitate assemble or dissemble of the built-in extension bar 101. As shown in FIGS. 1 and 3, the first surface feature is an indent.

In one embodiment of the present invention, referring to FIG. 2C, a cross section view of the tail portion of the ratchet shaft is shown. The cross section view is taken parallel to the length direction of the tail portion. The tail portion 20 comprises a hollow chamber 70. At the end of one interior of wall of the hollow chamber 70, a first set of threads 100 is provided. A separation groove 80 defines a chamber region 70 and extension region 90. The first set of the threads 100 is configured to mate tightly with surface thread 130 of the extension bar 110. The extension region 90 inside the tail portion is configured to accommodate a square drive end 120 of the built-in extension bar 110. The chamber is region is configured to contain the length of the extension bar except the square drive 120 and portion of the extension bar which bears surface feature 190. In another words, when the extension bar 110 is placed inside the tail portion 20 of the ratchet shaft, the surface feature 190 is exposed outside of the tail portion 20. In one example, the inside diameters of the chamber region and extension region 90 are different. In another example, as shown in FIG. 2*c*, the inside diameter for the chamber region is smaller than that of the extension region 90, which is configured to accommodate the square end 120 in place during storage.

Extension Bar

According to a fourth aspect of the present invention, the ratchet handle disclosed herein comprises a removable extension bar 110. The extension bar 110 is placed inside the hollow chamber and extension region 90 of the tail portion 20 of the ratchet shaft. The extension bar 110 provides extra reach for tight spaces, and also serves as an adapter to allow a worker to use a different drive size socket. The extension bar can be at any length for example, 3", 5" or 2".

The extension bar 110 comprises a first connecting end, a second connecting end 120, and a second set of threads 130. The second set of threads (130) is placed on the exterior of the extension bar more towards the first connecting end than the second connecting end 120. The second thread 130 is configured to mate with the interior thread 100 of the hollow chamber while the extension bar 110 is screwed inside of the tail portion 20.

In one embodiment of the present invention, the first connecting end substantially resembles a socket, having an opening to receive a drive square for example the drive square 140. In one example, the first connecting end has a square opening. In another embodiment of the present invention, on the exterior of the first connecting end, a first surface feature 190 is provided. The surface feature 190 is configured to improve grip to facilitate insertion and removal of the insertion member 110 by hand. When the extension bar is fastened inside the tail portion of the ratchet shaft, the first surface feature 190 is exposed outside of the tail portion of the ratchet shaft.

In another embodiment of the present invention, the second connecting end substantially resembles a square drive, having a protrusion to be fitted in an opening. In one example, the square drive 120 of the second connecting end can be fit into the square opening of the hexagon head 150 of the second attachment.

In one example of the present invention, the extension bar 110 is used to help the ratchet reach deep spaces. The square drive 140 for the ratchet head is at the same size as that of the square drive 120 of the extension bar 110. In another example of the present invention, the extension bar 110 is used to serve as an adapter to attach a different size socket. The square drive 140 for the ratchet head is a bigger size than that of the square drive 120 of the extension bar 110.

Transitional Middle Portion

The transitional middle portion 30 connects the head portion 10 and tail portion 20. Referring to FIG. 3, the enlarged head portion 10 having a height H and the tail portion 20 has diameter D. The transitional middle portion has various heights along its elongated direction. Further the transitional middle portion has a third surface feature 220, configured to provide increased surface friction and improved hand grip.

In one embodiment of the present invention, the head portion, having a first height of H, the tail portion, substantially cylindrically shaped, having a first diameter D and the transitional middle portion has various diameters (or height) E extending from the head portion to the tail portion. In one example E is between H and D. In another example, one height or diameter E is equal to D.

The first, second and third surface features (210, 190 and 220) are not limited to what has been depicted in the figures. The surface features disclosed herein can be one indent or a series of grooves, even patches like sand papers, or the like. Which are configured to offer friendly use and ergonomic gesture for a worker. The second surface feature on the extension bar is meant to facilitate thumb screw or finger screw motions.

The references in the figures are the following:

10 head portion of the ratchet shaft
20 tail portion of the ratchet shaft
30 transition middle portion of the ratchet shaft
40 second surface of the head portion of ratchet shaft
50 reversible lever
60 first surface of the head portion of ratchet shaft
70 hollow chamber of the tail portion
80 separation groove
90 extension region
100 thread of the hollow member
110 extension bar
120 square drive of the extension bar
130 thread of the extension bar
140 square drive on the first surface of the head
150 hexagon head on the second surface of the head
160 four declining surfaces between inner circle of the square opening of the hexagon head
170 wrench
180 another ratchet
190 surface feature of first connecting end (the second surface feature)
200 ball stop on a square drive
210 surface indent of the tail portion (the first surface feature)
220 surface feature on the middle portion (the third surface feature)
230 square opening of the hexagon head Although the invention has been disclosed in detail with reference only to the exemplary embodiments, those skilled in the art will appreciate that various other embodiments can be provided without departing from the scope of the invention. Accordingly, the invention is defined only by the claims set forth below.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments. Furthermore, for ease of understanding, certain method procedures may have been delineated as separate procedures; however, these separately delineated procedures should not be construed as necessarily order dependent in their performance. That is, some procedures may be able to be performed in an alternative ordering, simultaneously, etc. In addition, exemplary diagrams illustrate various methods in accordance with embodiments of the present disclosure. Such exemplary method embodiments are described herein using and can be applied to corresponding apparatus embodiments, however, the method embodiments are not intended to be limited thereby.

Although few embodiments of the present invention have been illustrated and described, it would be appreciated by those skilled in the art that changes may be made in these embodiments without departing from the principles and spirit of the invention. The foregoing embodiments are therefore to be considered in all respects illustrative rather than limiting on the invention described herein. Scope of the invention is thus indicated by the appended claims rather than by the foregoing description, and all changes which come within the meaning and range of equivalency of the claims are intended to be embraced therein. Terms in the claims should be given their broadest interpretation consistent with the general inventive concept as set forth in this description. As another example, "having" and "including", derivatives thereof and similar transitional terms or phrases are used synonymously with "comprising" (i.e., all are considered "open ended" terms)—only the phrases "consisting of" and "consisting essentially of" should be considered as "close ended".

I claim:

1. An integrated ratchet handle tool having an elongated shaft and a built-in extension bar;

the shaft comprising a ratchet head portion, having a first surface and a second surface, dispose opposite to each other, wherein the first surface has a first attachment means, configured to releasably receive a first connecting end of the extension bar to form a secure connection, wherein the first attachment means on the first surface of the head portion is a first square drive;

and the second surface has a second attachment means, configured to receive a second handle tool;

a tail portion, which is hollow such that it can allow the built-in extension bar to be partially placed inside when the extension bar is not being used; and a transitional middle portion, provided between the head portion and the tail portion of the elongated shaft; and the built in extension bar comprising surface threads between said first connecting end and a second connecting end and the extension bar is secured to the tail portion of the elongated handle by mating the surface threads of the extension bar with complimentary threads in an end interior wall of the tail portion of the shaft;

wherein inside of the hollow tail end, a hollow chamber and an extension region are provided, and the extension region, defined by a second end of the interior wall, is configured to accommodate said second connecting end of the extension bar and the extension region is separated from the hollow chamber by a separation groove on the interior wall of the tail portion;

the first connecting end and surface feature on the extension bar being exposed outside of the tail portion of the elongated shaft when the extension bar is secured to the tail portion;

wherein the second attachment means on the second surface of the head portion substantially resembles a hexagon shaped nut without any interior thread, the second attachment means on the second surface of the head portion is configured to allow the integrated ratchet handle to be used with said second hand tool to improve the ability to apply torque; and wherein the hexagonal shaped second attachment mean has a square opening comprising a decline surface.

2. The elongated ratchet handle of claim 1, wherein the second connecting end is configured to allow attachment of another connection.

3. The elongated ratchet handle of claim 1, wherein the first connecting end of the extension bar is a socket end having a square opening.

4. The elongated ratchet handle of claim 3, wherein the second connecting end of the extension bar is a second square drive.

5. The elongated ratchet handle of claim 3, wherein a second square drive of the extension bar has a different dimension than that of the first square drive of the head portion of the integrated ratchet handle.

6. The elongated ratchet handle of claim 3, wherein the head portion, having a first height of H;

the tail portion, substantially cylindrically shaped, having a first diameter D;

characterized in that the transitional middle provides a third surface feature allowing comfortable grip and the transitional middle portion has various diameters E extending from the head portion to the tail portion.

7. The elongated ratchet handle of claim 6, wherein an exterior surface of the first connecting end of the extension bar further comprise a first surface feature configured to allow a finger or hand grip to facilitate insertion or removal of the built-in extension bar.

8. The elongated ratchet handle of claim 6, wherein E is between H and D or equal to D.

9. The elongated ratchet handle of claim 1 being part of a system including the second hand tool which is a wrench or a ratchet handle.

* * * * *